United States Patent [19]

Holtzberg et al.

[11] 4,430,970

[45] Feb. 14, 1984

[54] COMPOSITE TAPPET

[75] Inventors: Matthew W. Holtzberg, Ringwood, N.J.; Steven J. Henke, Woodridge; Wray V. McKenzie, Jr., West Chicago, both of Ill.

[73] Assignee: Standard Oil Company (Indiana), Chicago, Ill.

[21] Appl. No.: 387,361

[22] Filed: Jun. 11, 1982

[51] Int. Cl.[3] ..... F01L 1/14

[52] U.S. Cl. ..... 123/90.51; 264/235; 264/236; 264/328.12

[58] Field of Search ..... 123/90.51; 29/156.7 B; 264/235, 236, 328.12

[56] References Cited

U.S. PATENT DOCUMENTS 3,748,304 7/1973 Stephens ..... 528/210

4,016,140 4/1977 Morello ..... 264/331.19

4,224,214 9/1980 Chen ..... 264/325

FOREIGN PATENT DOCUMENTS 1020632 2/1953 France ..... 123/90.51

OTHER PUBLICATIONS

Wise; Charles "Plastic Engine is Off and Running," *Machine Design,* vol. 52, No. 10 (May 8, 1980) pp. 24–26.

*Primary Examiner*—William A. Cuchlinski, Jr.

*Attorney, Agent, or Firm*—Thomas W. Tolpin; William H. Magidson; William T. McClain

[57] ABSTRACT

A lightweight composite tappet is provided to decrease fuel consumption, attenuate noise, and permit increased speed of operation.

29 Claims, 6 Drawing Figures

COMPOSITE TAPPET

BACKGROUND OF THE INVENTION

This invention relates to engines, and more particularly, to engine parts and a process for making the same.

Traditionally, engines have been made of metal, usually steel or cast iron. Steel and cast iron engines are useful, except they are quite heavy and consume considerable amounts of gasoline or diesel fuel. Conventional engines exert large compressive forces, considerable torque, and substantial secondary harmonic vibrations which have to be dampened by counterbalancing pistons, flywheels, dampeners, etc. The moving metal parts of cast iron and steel engines generate high centrifugal, reciprocating, and inertial forces, momentum, and loads. Generally, the weight of the engine adversely affects its performance, efficiency, and power.

Recently, it has been suggested to use plastic engine parts in automotive engines. Such suggestions have appeared in the December 1980 issue of *Automotive Industries* at pages 40–43, in an article entitled, "What . . . a Plastic Engine!?;" in the May 8, 1980 issue of *Machine Design,* Volume 52, No. 10, in an article entitled, "Plastic Engine Is Off And Running," and in French Application No. 2,484,042, published Dec. 11, 1981.

An experimental prototype engine with concealed plastic engine parts was displayed at the Society of Automotive Engineers' (SAE) Show in Detroit, Mich. in February 1980.

Over the years, amide-imide polymers have been developed for use in molding and producing various products, such as wire coatings, enamels, films, impregnating materials, and cooking utensils. Typifying these prior art amide-imide products, polymers and molding processes are those described in U.S. Pat. Nos. 3,546,152; 3,573,260; 3,582,248; 3,660,193; 3,748,304; 3,753,998; 4,016,140; 4,084,144; 4,136,085; 4,186,236; 4,167,620; and 4,224,214. These prior art products, polymers, and molding processes have met with varying degrees of success.

It is, therefore, desirable to provide a light-weight engine part.

SUMMARY OF THE INVENTION

An improved lightweight composite engine part is provided for use in gasoline and diesel powered automotive engines, truck engines, aircraft engines, marine engines, single and two cylinder engines, such as lawn mower engines, portable generators, and other internal combustion engines. The lightweight composite engine part decreases gasoline and fuel consumption, attentuates noise for quieter performance, and permits increased speed of operation. The lightweight composite engine part produces higher horsepower for its weight than conventional engine parts, while maintaining its shape, dimensional stability, and structural integrity at engine operating conditions. The lightweight composite engine part decreases centrifugal, reciprocating, and inertial forces, momentum, and load on the engine.

The composite engine part has a greater stiffness-to-weight ratio than metal, is flame resistant, and is stable to heat. The composite engine part is capable of effectively functioning at engine operating temperatures and start-up conditions during hot and cold weather. The composite engine part has high mechanical strength, thermal stability, fatigue strength, and excellent tensile, compressive, and flexural strength. The composite engine part is resistant to wear, corrosion, impact, rupture, and creep, and reliably operates in the presence of engine fuels, oils, and exhaust gases.

In contrast to metals, such as cast iron, steel, aluminum, titanium, and to thermosetting resins, such as epoxy resin, the composite engine part can be injection molded. Injection molding permits closer tolerance with less secondary machining operations for production efficiency and economy. Finished surfaces of injected molded composite engine parts are of better quality and have fewer knit lines, seams, and flashes than do engine parts made from cold metal forging, casting, fabrication, or other conventional techniques. If desired, some of the composite engine parts can be insert molded or compression molded.

The lightweight composite engine part is made of durable, impact-resistant, hybrid or composite material which includes special proportions of an amide-imide resinous polymer, preferably reinforced with graphite and/or glass fibers. The amide-imide resinous polymer can also be blended with polytetrafluoroethylene (PTFE) and/or titanium dioxide. Composite engine parts which are injection molded or otherwise made from amide-imide resinous polymers have better elongation, stiffness, moduli, and strength at engine operating conditions than do other plastics, such as epoxy resin, polyimides, aramids, polyphenylene sulfide, polytetrafluoroethylene, and nylon. A particularly suitable amide-imide resinous polymer is commercially available from Amoco Chemicals Corporation under the trademark and product designation TORLON.

In the invention of this application, the composite engine part takes the form of a thermoplastic, amide-imide resinous polymeric tappet. The thermoplastic tappet has an elongated skirt which annularly surrounds and receives a valve spring retainer. The circular disc extends laterally across the skirt and cooperates with the skirt to define a valve spring-receiving chamber or seat. The side of the disc forming part of the valve seat is generally planar or flat and provides a valve-engaging surface for abuttingly engaging and reciprocatingly driving a valve. The opposite side of the disc faces generally upwardly and is driven by an overhead cam. In the preferred form, the upwardly facing side of the disc has a countersunk recess which receives a metal cam-engaging shim. Desirably, the shim provides a cam seat which abuttingly engages and is driven by the overhead cam.

An annular rim provides a cam guide rail which extends longitudinally from the disc in a generally upward direction away from the downwardly depending skirt. Preferably, the skirt and rim have flush outer surfaces which are positioned in coplanar alignment with each other to provide an integral tappet wall which reciprocatingly slides against the cylinder wall. In the preferred form, the rim has a pair of diametrically opposed oil grooves.

The composite tappet is preferably molded, allowed to cure below its plastic deformation temperature to solidify its shape, and then post cured by solid state polymerization to increase its strength. In the preferred injection molding process, a core is inserted in a generally tappet-shaped cavity of a mold to define a generally tappet-shaped molding chamber, and a thermoplastic amide-imide resinous polymer is injected into the cavity at a location generally opposite the core to minimize knit lines. The molded tappet-shaped blank has an annular skirt and a generally circular disc extending across the skirt. The molded tappet-shaped blank can also have an annular rim providing the cam guide rail.

After the molded tappet-shaped blank is post cured, oil grooves are cut into the rim and a recess is countersunk or otherwise cut into the disc. Thereafter, a metal shim is placed in the recess to provide the cam seat. The molded tappet-shaped blank can also undergo various other machining operations, as desired.

Composite valve train parts, such as composite tappets increase the natural frequency of the valve train. Composite valve train parts are more stable at engine operating conditions, minimize floating, and substantially prevent the valve train from getting out of synchronization with the cam. Composite valve trains produce less deflection and distortion, and enhance better cam timing.

A more detailed explanation of the invention is provided in the following description and appended claims taken in conjunction with the accompanying drawings.

DETAILED DESCRIPTION OF THE PREFERRED EMBODIMENT

Figure 1:
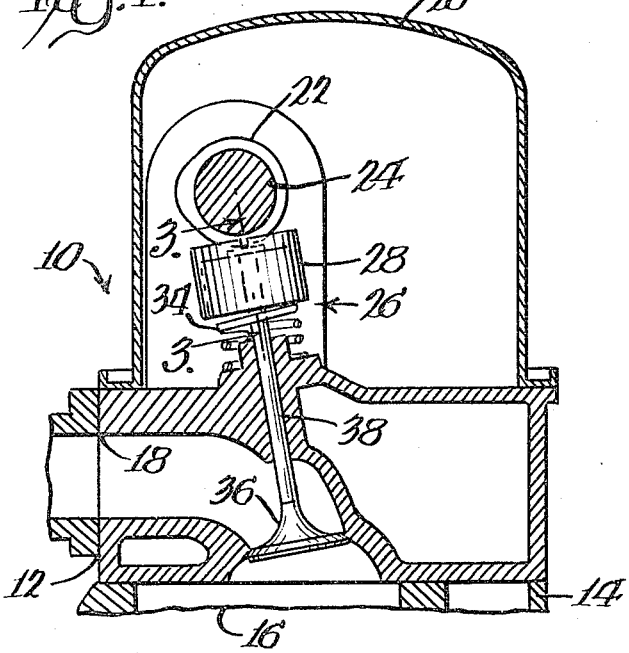
FIG. 1 is a fragmentary cross-sectional view of an automotive engine with a composite tappet in accordance with principles of the present invention.

The automotive engine 10 of FIG. 1 has light-weight composite engine parts to reduce its weight, decrease fuel consumption, and improve engine performance. Engine 10 is a gasoline powered, overhead cam, spark ignition engine. While the composite engine parts are described hereinafter with particular reference to the illustrated engine, it will be apparent that the composite engine parts can also be used in other types of overhead cam engines, such as diesel powered automotive engines, truck engines, aircraft engines, marine engines, locomotive engines, lawn mower engines, portable generators, and other internal combustion engines.

As shown in FIG. 1, engine 10 has a cast iron head 12 and block 14. The block has combustion chambers 16 which provide cylinders. The head has an exhaust manifold and intake manifold 18 which communicate with the cylinders. Extending above the head is a rocker arm cover 20.

Metal cams 22 are mounted on the camshaft 24 to reciprocatingly drive the valve trains 26. There are two or four valve trains per cylinder depending on the type of overhead engine. Each valve train has a tappet 28, a valve spring retainer 30 (FIG. 3), split keeper rings or locking keys 32, a compression spring 34, and a valve 36 which opens and closes the exhaust manifold or the intake manifold. The intake valve opens and closes the intake manifold. The exhaust valve opens and closes the exhaust manifold. The overhead cam 22 cammingly engages, dynamically abuts against, and reciprocatingly drives the tappet 28. The tappet 28 houses the valve spring retainer 30 and locking keys 32, and dynamically engages against and reciprocatingly drives the valve stem 38 of valve 36.

In a four stroke internal combustion engine, such as the illustrated overhead cam engine, each piston has an intake stroke, a compression stroke, a power stroke and an exhaust stroke. During the intake stroke, the piston moves downward and the inlet valve is opened to permit a gaseous air mixture to fill the combustion chamber (cylinder). During the compression stroke, the intake and exhaust valves are closed and the piston moves upward to compress the gaseous air mixture. During the power stroke, the spark plug is ignited to combust the gaseous air mixture in the combustion chamber and the rapidly expanding combustion gases drive the piston downward. During the exhaust stroke, the exhaust valve is opened and the piston moves upward to discharge the combustion gases (exhaust gases).

The tappets, as well as the valve spring retainers and intake valves, can be made of metal, although it is preferred that they are at least partially made of a thermoplastic, amide-imide resinous polymer to reduce the weight of the engine. Such amide-imide engine parts are referred to as composite engine parts. In some engines, the exhaust valve can also be at least partially made of a thermoplastic, amide-imide resinous polymer.

Figure 2:
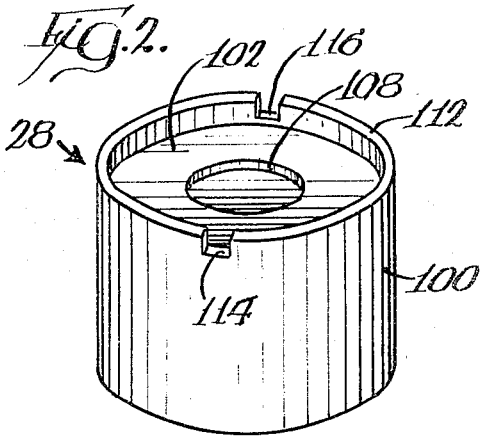
FIG. 2 is a perspective view of the composite tappet.
Figure 3:
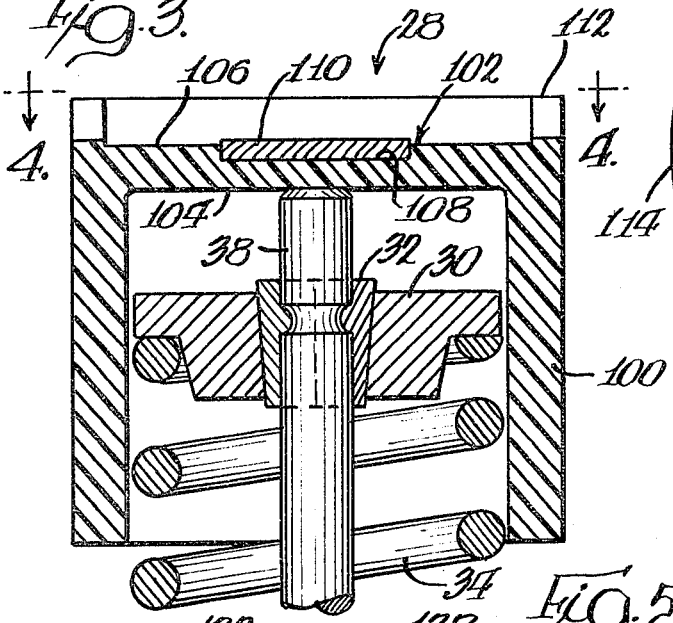
FIG. 3 is a cross-sectional view of the composite tappet taken substantially along line 3—3 of FIG. 1.
Figure 4:
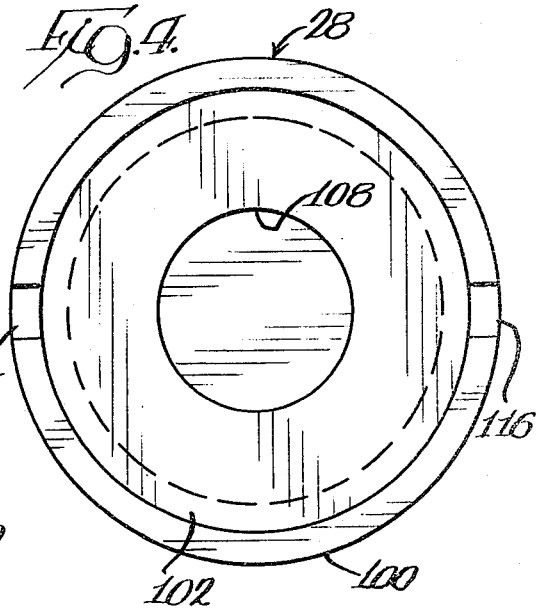
FIG. 4 is a top plan view of the composite tappet.

As shown in FIGS. 2–4, the composite, thermoplastic amide-imide resinous polymeric tappet 28 has an elongated annular skirt 100 and a generally circular disc 102 that extends laterally across the skirt. The disc and skirt cooperate with each other to provide a valve spring-receiving chamber or socket which houses and receives the valve spring retainer 32. The inside diameter of the skirt should be slightly larger than the outside diameter of the valve spring retainer and the compression spring 34. The bottom of the disc 102 is a generally planar or flat valve-engaging surface 104 which provides a valve seat and defines part of the valve spring-receiving chamber. The valve seat 104 abuts against and reciprocatingly drives the upper end of the valve stem 38 to open and close the valve. The opposite side or top of the disc provides a cam-engaging surface 106 with flat portions and a countersunk recess 108.

A metal cam-engaging shim 110 snuggly set in the recess 108 provides a cam seat. The top of the metal shim can extend slightly above the surface 106 of the disc or can be flush with the surface, as desired. The metal cam-engaging shim is preferably made of steel or aluminum. The shim rides upon, follows, abuttingly engages, and is reciprocatingly driven by the overhead cam 22.

An annular rim 112 extends integrally upwardly from the disc in a direction generally opposite the skirt. The rim 112 provides a cam guide rail to help contain the cam. The cam guide rail cooperates with the cam-engaging shim 110 and the cam-driven surface 106 of the disc to form a composite cam seat chamber. The rim 112 and skirt have flush outer surfaces which are positioned in coplanar alignment with each other to provide a tappet wall which reciprocatingly slides against the cylinder wall. In the illustrative embodiment, the rim has a pair of diametrically opposed oil grooves 114 and 116.

The composite tappet is approximately 70% lighter than conventional metal tappets. Advantageously, the composite tappet maintains its structural shape and integrity at engine operating conditions. The coefficient and rate of thermal expansion and contraction of the amide-imide polymeric tappet are similar to those of the metal cam seat, so that the thermoplastic tappet expands and contracts compatibly with the metal cam seat at engine operating conditions.

Figure 5:
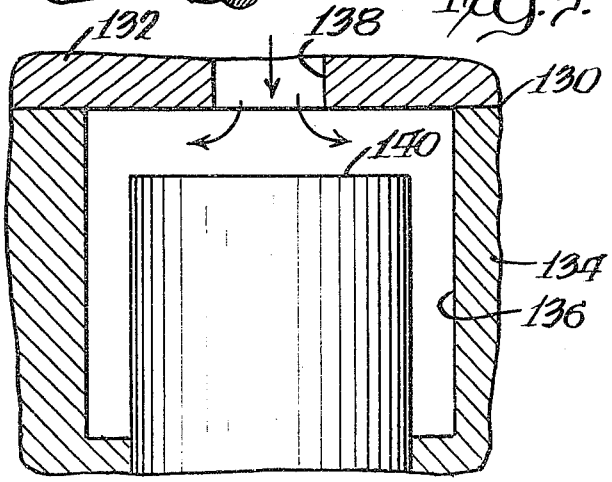
FIG. 5 is a cross-sectional view of a die for injection molding the composite tappet.

The composite tappet is preferably injection molded for closer tolerances, minimal secondary machining operations, and enhanced structural strength. As shown in FIG. 5, the injection mold 130 provides a die with an upper molding portion or cope 132 and a lower molding portion or drag 134. The mold has a series of generally tappet-shaped die cavities 136 which are connected to each other by gates (not shown). The cavity should be well vented with vent holes preferably from 0.002 inch to 0.004 inch in diameter, and should have a draft from 0.5° to 1.5° to facilitate removal of the molded tappet.

An inlet or sprue 138 allows the injection moldable, amide-imide resinous polymer to flow into the cavity of the mold. A removable core pin or core 140 is inserted into the cavity of the mold to help form the spring-receiving chamber. The core cooperates with the cavity to define a generally tappet-shaped molding chamber.

In order to minimize knit lines in the injection molded tappet, the sprue 138 and core 140 should be located opposite each other along the axis of the tappet. During injection molding, the amide-imide resinous polymer is injected into the molding cavity through sprue 138 at injection molding temperatures and pressures to fill the cavity and molding chamber, so as to form a thermoplastic, amide-imide resinous polymeric tappet-shaped blank. The blank should then be allowed to cool below its plastic deformation temperature to solidify its shape and polymeric orientation. The injection molding temperature (polymer melt temperature) of the polymer is preferably from 630° F. to 670° F., which is slightly above the plastic deformation temperature of the amide-imide polymer. The total molding and cooling time ranges from 15 to 30 seconds, depending on the grade of the polymeric resin and the desired cross-sectional thickness of the molded tappet.

Figure 6:
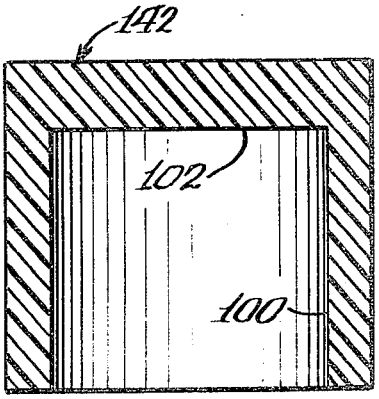
FIG. 6 is a cross-sectional view of an injection molded tappet blank prior to machining.

After the tappet-shaped blank has cooled below its plastic deformation temperature, the core 140 is removed and the blank is removed from the mold. Thereafter, the resinous sprue and runners are removed, either manually or mechanically, to form the blank 142 shown in FIG. 6. The injection molded tappet-shaped blank 142 has an annular skirt 100 and a circular disc which extends across the skirt.

The cooled molded engine part providing the blank is then post cured by solid state polymerization by progressively heating the molded engine part below its melting temperature to enhance its dimensional strength and integrity. The specific time and temperatures depend upon the desired size of the molded part.

In the preferred method of post curing, the molded engine part is preheated in the presence of a circulating gas in an oven for a period of time such that a major portion of the volatiles contained in the injection molded engine part are vaporized and removed, while simultaneously increasing the deflection temperature of the polymer from about 15° F. to 35° F. without deformation of the engine part. Preheating can be carried out by heating the molded part from an initial temperature to a final temperature with either continuous or stepwise increases in temperature over a period of time, or at a single temperature, for a sufficient time to vaporize and remove the volatiles and increase the polymer's deflection temperature.

Imidization, cross-linking and chain extension take place during preheating. Continuous or stepwise preheating increases tensile strength and elongation properties of the molded engine parts.

In order to enhance the physical properties of smaller molded engine parts, it is preferred to continuously preheat the molded part from an initial temperature of 300° F. to 330° F. to a final preheating temperature of 460° F. to 480° F. for about 40 to 60 hours. Alternatively, the molded engine part can be preheated in a stepwise manner from an initial preheating temperature of 300° F. to 330° F. for 20 to 30 hours to a final preheating temperature of 410° F. to 430° F. for 20 to 30 hours.

Generally, the molded part is heated (post cured) at a temperature of about 330° F. for 24 hours, about 475° F. for 24 hours, and about 500° F. for 24 hours. More specifically, the molded article is heated in the presence of a circulating gas at about 5° F. to 25° F., and preferably about 5° F. to 15° F., below the increased deflection temperature of the polymer for a period of time such that substantial imidization, chain extension and cross-linking take place without deformation of the molded article.

As a result of such heating, water and gases continue to be generated and removed, and the molecular weight and deflection temperature of the polymer are increased. Heating is continued for a period of time sufficient to increase the deflection temperature by about 15° F. to 35° F. Preferably, the heating is at a temperature range from about 450° F. to 490° F. for a period of at least 20 hours. Thereafter, the temperature is increased to about 5° F. to 25° F. below the polymer's new deflection temperature and held at the new temperature for a sufficient time to increase the polymer's deflection temperature by about 15° F. to 35° F. Preferably, such heating is at about 480° F. to 520° F. for a period of at least 20 hours.

Heating is continued in this manner to increase the polymer's deflection temperature to its maximum attainable value without deformation of the molded article. The final heating stage is carried out at about 5° F. to 25° F., and preferably from about 5° F. to 15° F., below the maximum attainable temperature for at least 20 hours, and most preferably at least 40 hours. The heated part is then cooled.

In order to best enhance the physical properties of the molded engine part, it is preferred to heat the molded part from about 460° F. to about 480° F. for about 20 to 30 hours, then from about 490° F. to 510° F. for about 20 to 30 hours, and subsequently from about 495° F. to about 525° F. for about 20 to 60 hours.

Post curing should be carried out in the presence of a circulating gas which flows through and around the molded engine part to remove water and gases from the polymeric resin. The amount of circulation and the circulation flow pattern should be coordinated to maximize removal of water and the gases without causing substantial variations in temperature. While inert gases, such as nitrogen, can be used, it is preferred that the circulating gas be an oxygen-containing gas, most preferably air, because oxygen tends to facilitate cross-linking of the polymer molecules. Post curing is preferably carried out in a circulating air oven, although it can be carried out in any other suitable apparatus.

Post cured engine parts are resistant to thermal shock at temperatures of at least 500° F. and exhibit significantly improved tensile strength and elongation as compared with untreated molded, amide-imide resinous engine parts. A more detailed explanation of heat treatment by post curing is described in Chen U.S. Pat. No. 4,167,620, which is hereby incorporated by reference.

After the molded engine part is post cured, recesses are cut into the tappet-shaped blank to form the rim 112, cam-driven surface 106, countersunk shim-receiving recess 108, and oil grooves 114 and 116. If desired, the rim 112 can be injection molded along with the rest of the tappet-shaped blank. The tappet should be ground, as desired.

While the machining operations described above are preferably conducted after the injection molded engine part is post cured, one or more of these machining operations can be conducted before post curing if desired.

The composite engine part and the thermoplastic, amide-imide resinous polymer contained therein substantially maintain their shape, dimensional stability and structural integrity at engine operating conditions. Usual engine operating temperatures do not exceed 350° F. Oil cooled engine operating temperatures range from about 200° F. to 250° F. Advantageously, the composite thermoplastic, amide-imide resinous, polymeric engine part is impervious and chemically resistant to oil, gasoline, diesel fuel, and engine exhaust gases at engine operating conditions.

The thermoplastic resin in the composite engine part comprises 40% to 100%, preferably 65% to 75%, by weight amide-imide resinous polymer. The polymer is preferably reinforced with graphite fibers and/or glass fibers. In molded parts the fibers have an average length of 6 to 10 mils and a preferred diameter of about 0.2 to 0.4 mils. The ratio of the length to diameter of the fibers is from 2 to 70, averaging about 20. While the above fiber lengths and diameters are preferred for best structural strength, other lengths and diameters can be used, if desired. The graphite fibers can be granulated or chopped and can be optionally sized or coated with a polysulfone sizing or some other polymer which will maintain its structural integrity at engine operating conditions. The glass fibers can be milled or chopped and can be sized with silane or some other polymer that maintains its structural integrity at engine operating conditions. Chopped graphite and glass fibers are preferably sized, while granulated graphite fibers are preferably unsized.

Desirably, the thermoplastic, amide-imide resinous polymer comprises 10% to 50%, preferably 30% to 34%, by weight graphite fibers or 10% to 60%, preferably 30% to 34%, by weight glass fibers. The polymer can have as much as 3% and preferably ½% to 1% by weight powdered or granular polytetrafluoroethylene (PTFE) and/or as much as 6% by weight titanium dioxide. In some circumstances it may be desirable to add more PTFE.

The polymer's molding characteristics and molecular weight can be controlled to facilitate polymerization with an additional monomer, such as trimellitic acid (TMA), and can be prepared with the desired flow properties by the methods described in Hanson U.S. Pat. No. 4,136,085, which is hereby incorporated by reference.

The polymer can be blended with graphite, glass, PTFE, and titanium dioxide by the method described in Chen U.S. Pat. No. 4,224,214, which is hereby incorporated by reference.

The most preferred amide-imide polymer is reinforced with 30% by weight graphite fibers and has the following engineering properties:

TABLE I

| Property | Typical Value | Units | ASTM Test Method |
|---|---|---|---|
| Mechanical Properties | | | |
| Tensile Strength | | psi | D1708 |
| @ −321° F. | 22,800 | | |
| @ 73° F. | 29,400 | | |
| @ 275° F. | 22,800 | | |
| @ 450° F. | 15,700 | | |
| Tensile Elongation | | % | D1708 |
| @ −321° F. | 3 | | |
| @ 73° F. | 6 | | |
| @ 275° F. | 14 | | |
| @ 450° F. | 11 | | |
| Tensile Modulus | | psi | D1708 |
| @ 73° F. | 3,220,000 | | |
| Flexural Strength | | psi | D790 |
| @ −321° F. | 45,000 | | |
| @ 73° F. | 50,700 | | |
| @ 275° F. | 37,600 | | |
| @ 450° F. | 25,200 | | |
| Flexural Modulus | | psi | D790 |
| @ −321° F. | 3,570,000 | | |
| @ 73° F. | 2,880,000 | | |
| @ 275° F. | 2,720,000 | | |
| @ 450° F. | 2,280,000 | | |
| Compressive Strength | 32,700 | psi | D695 |
| Shear Strength | | psi | D732 |
| @ 73° F. | 17,300 | | |
| Izod Impact | | ft.-lbs./in. | D256 |
| @ 73° F. | 0.9 | | |
| Thermal Properties | | | |
| Deflection Temperature | | °F. | D648 |
| @ 264 psi | 540 | | |
| Coefficient of Linear Thermal Expansion | $5 \times 10^{-6}$ | in./in./°F. | D696 |
| Thermal Conductivity | 3.6 | $\frac{\text{btu-in.}}{\text{hr.-ft.}^2\text{-°F.}}$ | C177 |
| Flammability | 94V0 | Underwriters Laboratories | 94 |
| Limiting Oxygen Index | 52 | % | D2863 |
| General Properties | | | |
| Density | 1.42 | g/cc | D792 |
| Hardness "Rockwell" E | 94 | | |
| Water Absorption | 0.26 | % | D570 |

The preferred, glass reinforced, thermoplastic amide-imide resinous polymer comprises 30% by weight glass fibers and has the following properties:

TABLE II

| Property | Typical Value | Units | ASTM Test Method |
|---|---|---|---|
| Mechanical Properties | | | |
| Tensile Strength | | psi | D1708 |
| @ −321° F. | 29,500 | | |
| @ 73° F. | 29,700 | | |
| @ 275° F. | 23,100 | | |
| @ 450° F. | 16,300 | | |
| Tensile Elongation | | % | D1708 |
| @ −321° F. | 4 | | |
| @ 73° F. | 7 | | |
| @ 275° F. | 15 | | |
| @ 450° F. | 12 | | |
| Tensile Modulus | | psi | D1708 |
| @ 73° F. | 1,560,000 | | |
| Flexural Strength | | psi | D790 |
| @ −321° F. | 54,400 | | |
| @ 73° F. | 48,300 | | |
| @ 275° F. | 35,900 | | |
| @ 450° F. | 26,200 | | |
| Flexural Modulus | | psi | D790 |
| @ −321° F. | 2,040,000 | | |
| @ 73° F. | 1,700,000 | | |
| @ 275° F. | 1,550,000 | | |

TABLE II-continued

| Property | Typical Value | Units | ASTM Test Method |
|---|---|---|---|
| @ 450° F. | 1,430,000 | | |
| Compressive Strength | 34,800 | psi | D695 |
| Shear Strength | | psi | D732 |
| @ 73° F. | 20,100 | | |
| Izod Impact | | ft.-lbs./in. | D256 |
| @ 73° F. | 1.5 | | |
| Thermal Properties | | | |
| Deflection Temperature | | °F. | D648 |
| @ 264 psi | 539 | | |
| Coefficient of Linear Thermal Expansion | $9 \times 10^{-6}$ | in./in./°F. | D696 |
| Thermal Conductivity | 2.5 | $\frac{\text{btu-in.}}{\text{hr.-ft.}^2\text{-°F.}}$ | C177 |
| Flammability | 94V0 | Underwriters Laboratories | 94 |
| Limiting Oxygen Index | 51 | % | D2863 |
| Electrical Properties | | | |
| Dielectric Constant | | | D150 |
| @ $10^3$ Hz | 4.4 | | |
| @ $10^6$ Hz | 6.5 | | |
| Dissipation Factor | | | D150 |
| @ $10^3$ Hz | .022 | | |
| @ $10^6$ Hz | .023 | | |
| Volume Resistivity | $6 \times 10^{16}$ | ohms-in. | D257 |
| Surface Resistivity | $1 \times 10^{18}$ | ohms | D257 |
| Dielectric Strength | 835 | volts/mil. | |
| General Properties | | | |
| Density | 1.56 | g/cc | D792 |
| Hardness "Rockwell" E | 94 | | |
| Water Absorption | 0.24 | % | D570 |

The amide-imide polymers are prepared by reacting an aromatic polycarboxylic acid compound (acyl halide carboxylic acid and/or carboxylic acid esters) having at least three carboxylic acid groups such as trimellitic acid (TMA), 4-trimellitoyl anhydride halide (4-TMAC), pyromellitic anhydride, pyromellitic acid, 3,4,3',4' benzophenone tetracarboxylic acid or an anhydride thereof, or oxybis benzene dicarboxylic acid or an anhydride thereof.

The amide-imide polymers are preferably prepared by reacting an acyl halide derivative of an aromatic tricarboxylic acid anhydride with a mixture of largely- or wholly-aromatic primary diamines. The resulting products are polyamides wherein the linking groups are predominantly amide groups, although some may be imide groups, and wherein the structure contains free carboxylic acid groups which are capable of further reaction. Such polyamides are moderate molecular weight polymeric compounds having in their molecule units of:

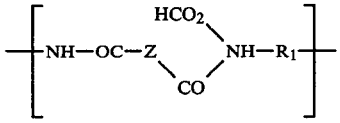

and units of:

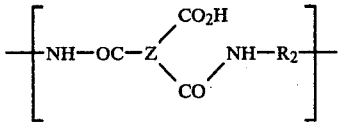

and, optionally, units of:

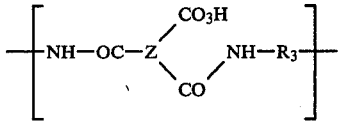

wherein the free carboxyl groups are ortho to one amide group, Z is an aromatic moiety containing 1 to 4 benzene rings or lower-alkyl-substituted benzene rings, $R_1$, $R_2$ and $R_3$ are different and are divalent wholly- or largely-aromatic hydrocarbon radicals. These hydrocarbon radicals may be a divalent aromatic hydrocarbon radical of from 6 to about 10 carbon atoms, or two divalent aromatic hydrocarbon radicals each of from 6 to about 10 carbon atoms joined directly or by stable linkages such as —O—, methylene, —CO—, —$SO_2$—, —S—; for example, —R'—O—R'—, —R'—$CH_2$—R'—, —R'—CO—R'—, —R'—$SO_2$—R'— and —R'—S—R'—.

The polyamides are capable of substantially complete imidization by heating by which they form the polyamide-imide structure having to a substantial extent reoccurring units of:

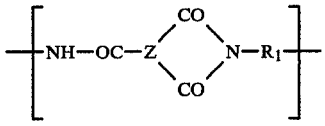

and units of:

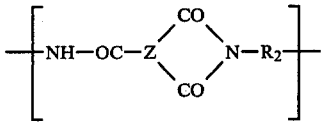

and, optionally, units of:

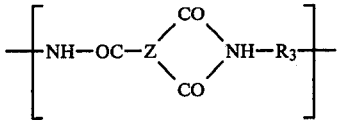

wherein one carbonyl group is meta to and one carbonyl group is para to each amide group and wherein Z, $R_1$, $R_2$ and $R_3$ are defined as above. Typical copolymers of this invention have up to about 50 percent imidization prior to heat treatment, typically about 10 to about 40 percent.

The polyamide-imide copolymers are prepared from an anhydride-containing substance and a mixture of wholly- or partially-aromatic primary diamines. Usefully the anhydride-containing substance is an acyl halide derivative of the anhydride of an aromatic tricarboxylic acid which contains 1 to 4 benzene rings or lower-alkyl-substituted benzene rings and wherein two of the carboxyl groups are ortho to one another. More preferably, the anhydride-containing substance is an acyl halide derivative of an acid anhydride having a single benzene or lower-alkyl-substituted benzene ring, and most preferably, the substance is the acyl chloride derivative of trimellitic acid anhydride (4-TMAC).

Usefully the mixture of diamines contains two or more, preferably two or three, wholly- or largely-aromatic primary diamines. More particularly, they are wholly- or largely-aromatic primary diamines containing from 6 to about 10 carbon atoms or wholly- or largely-aromatic primary diamines composed of two divalent aromatic moieties of from 6 to about 10 carbon atoms, each moiety containing one primary amine group, and the moieties linked directly or through, for example, a bridging —O—, —S—, —$SO_2$—, —CO—, or methylene group. When three diamines are used they are preferably selected from the class composed of:

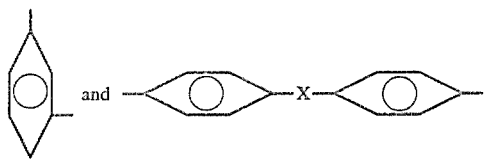

said X being an —O—, —$CH_2$—, or —$SO_2$— group. More preferably, the mixture of aromatic primary diamines is two-component and is composed of meta-phenylenediamine (MPDA) and p,p'-oxybis(aniline) (OBA), p,p'-methylenebis (aniline) (MBA), and p,p'-oxybis(aniline), p,p'-sulfonylbis(aniline) (SOBA), and p,p'-oxybis(aniline), p,p'-sulfonylbis(aniline) and meta-phenylenediamine, or p,p'-sulfonylbis (aniline) and p,p'-methylenebis(aniline). Most preferably, the mixture of primary aromatic diamines contains meta-phenylenediamine and p,p'-oxybis(aniline). The aromatic nature of the diamines provides the excellent thermal properties of the copolymers while the primary amine groups permit the desired imide rings and amide linkages to be formed.

When two diamines are used to achieve a polymer usefully combining the properties of both diamines, it is usual to stay within the range of about 10 mole % of the first diamine and 90 mole % of the second diamine to about 90 mole % of the first diamine and 10 mole % of the second diamine. Preferably the range is about a 20 to 80 mole ratio to about an 80 to 20 mole ratio. In the preferred embodiment wherein the acyl chloride of trimellitic acid anhydride is copolymerized with a mixture of p,p'-oxybis(aniline) and meta-phenylenediamine, the preferred range is from about 30 mole % of the former and about 70 mole % of the latter to about 70 mole % of the former and about 30 mole % of the latter.

Although embodiments of the invention have been shown and described, it is to be understood that various modifications and substitutions, as well as rearrangements of structural features and/or process steps, can be made by those skilled in the art without departing from the novel spirit and scope of this invention.

What is claimed is:

1. A composite engine part, comprising:

a metal cam-engaging shim providing a cam seat for abuttingly engaging and being driven by an overhead cam;

a thermoplastic, amide-imide resinous polymeric tappet having a disc with a top defining a countersunk recess for receiving said cam-engaging shim and a bottom providing a valve seat for abuttingly engaging and reciprocatingly driving a valve, an elongated annular skirt depending downwardly from said disc and cooperating with said valve seat to provide a valve-spring receiving chamber for receiving a valve spring retainer, and an annular rim providing a cam guide rail extending integrally upwardly from said disc in a direction generally opposite said skirt to substantially contain said cam, said cam-guide rail cooperating with said top of said disc and said cam-engaging shim to form a composite cam seat chamber; and said amide-imide tappet and said cam-engaging shim maintaining their structural shapes, integrity and relationship at engine operating conditions.

2. A composite engine part in accordance with claim 1 wherein said skirt and said rim have flush outer surfaces in coplanar alignment with each other for reciprocatingly sliding against a cylinder wall and said upwardly-extending cam-guide rail defines a pair of diametrically-opposed oil grooves.

3. A composite engine part in accordance with claim 1 wherein said metal comprises aluminum.

4. A composite engine part in accordance with claim 1 wherein said metal comprises steel.

5. A composite engine part in accordance with claim 1 wherein said tappet comprises a reaction product of a trifunctional carboxylic acid compound and at least one diprimary aromatic diamine.

6. A composite engine part in accordance with claim 5 wherein said tappet comprises at least one of the following moieties:

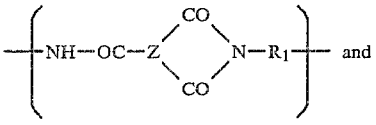

and

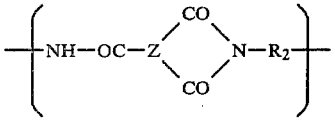

wherein one carbonyl group is meta to and one carbonyl group is para to each amide group and wherein Z is a trivalent benzene ring or lower-alkyl-substituted trivalent benzene ring, $R_1$ and $R_2$ are different and are divalent aromatic hydrocarbon radicals of from 6 to about 10 carbon atoms or two divalent aromatic hydrocarbon radicals of from 6 to about 10 carbon atoms joined directly or by stable linkages selected from the group consisting of —O—, methylene, —CO—, —$SO_2$—, and —S— radicals and wherein said $R_1$ and $R_2$ containing units run from about 10 mole percent $R_1$ containing unit and about 90 mole percent $R_2$ containing unit to about 90 mole percent $R_1$ containing unit and about 10 mole percent $R_2$ containing unit.

7. A composite engine part in accordance with claim 6 wherein $R_1$ is

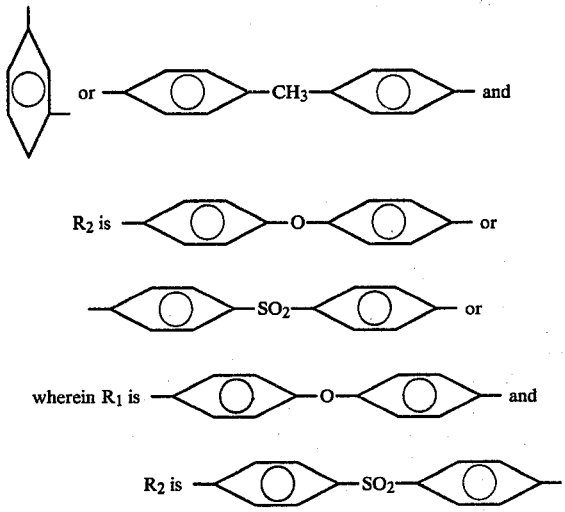

8. A composite engine part in accordance with claim 6 wherein Z is a trivalent benzene ring, $R_1$ is

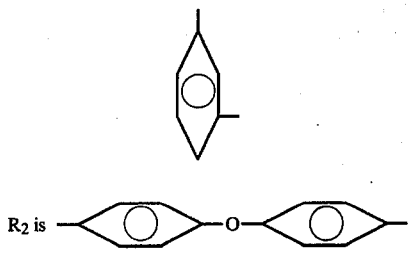

and wherein the concentration range runs from about 30 mole percent of the $R_1$ containing units and about 70 mole percent of the $R_2$ containing units to about 70 mole percent of the $R_1$ containing units and about 30 mole pecent of the $R_2$ containing units.

9. A composite engine part in accordance with claim 6 wherein said tappet comprises from 40% to 100% by weight amide-imide resinous polymer.

10. A composite engine part in accordance with claim 9 wherein said tappet comprises from 65% to 75% by weight amide-imide resinous polymer.

11. A composite engine part in accordance with claim 6 wherein said tappet comprises a fibrous reinforcing material selected from the group consisting essentially of graphite and glass.

12. A composite engine part in accordance with claim 11 wherein said tappet comprises from 10% to 50% by weight graphite.

13. A composite engine part in accordance with claim 12 wherein said tappet comprises from 30% to 34% by weight graphite.

14. A composite engine part in accordance with claim 11 wherein said tappet comprises 10% to 60% by weight glass.

15. A composite engine part in accordance with claim 14 wherein said tappet comprises 30% to 34% by weight glass.

16. A composite engine part in accordance with claim 11 wherein said fibrous reinforcing material has a polymeric sizing that substantially maintains its structural integrity at engine operating conditions.

17. A composite engine part in accordance with claim 11 wherein said tappet comprises not greater than 3% by weight polytetrafluoroethylene.

18. A composite engine part in accordance with claim 17 wherein said tappet comprises from ½% to 1% by weight polytetrafluoroethylene.

19. A composite engine part in accordance with claim 11 wherein said tappet comprises not more than 6% by weight titanium dioxide.

20. A process for forming a composite engine part, comprising the steps of:

inserting a core in a generally tappet-shaped cavity of a mold providing a die to define a generally tappet-shaped molding chamber;

injection molding a thermoplastic, amide-imide resinous polymer to form a generally tappet-shaped blank having an annular skirt for receiving a valve-spring retainer, a generally circular disc extending across said skirt, and a cam-guide rail extending generally opposite said skirt for substantially containing a cam, said injection molding including injecting said amide-imide polymer into said tappet-shaped cavity through a sprue at a location generally opposite said core to generally fill said molding chamber and substantially minimize knit lines in said amide-imide tappet-shaped blank;

allowing said tappet-shaped blank to cool below its plastic deformation temperature;

removing said core from said die;

post curing said amide-imide tappet-shaped blank by solid state polymerization to enhance the strength and integrity of said amide-imide tappet-shaped blank;

countersinking a recess in said disc; and placing a metal shim in said recess to provide a cam seat for engaging said being driven by said cam.

21. A process in accordance with claim 20 including grinding said tappet-shaped blank, and cutting diametrically-opposed oil grooves in said cam-guide rail.

22. A process in accordance with claim 20 wherein said amide-imide polymer is prepared by reacting a trifunctional carboxylic acid compound with at least one diprimary aromatic diamine.

23. A process in accordance with claim 22 wherein said amide-imide polymer comprises one of the following moieties:

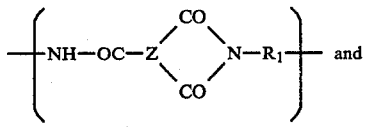

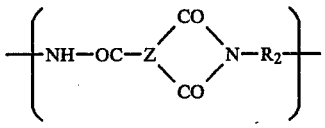

wherein one carbonyl group is meta to and one carbonyl group is para to each amide group and wherein Z is a trivalent benzene ring or lower-alkyl-substituted trivalent benzene ring, $R_1$ and $R_2$ are different and are divalent aromatic hydrocarbon radicals of from 6 to about 10 carbon atoms or two divalent aromatic hydrocarbon radicals of from 6 to about 10 carbon atoms joined directly or by stable linkages selected from the group consisting of —O—, methylene, —CO—, —$SO_2$—, and —S— radicals and wherein said $R_1$ and $R_2$ containing units run from about 10 mole percent $R_1$ containing unit and about 90 mole percent $R_2$ containing unit to about 90 mole percent $R_1$ containing unit and about 10 mole percent $R_2$ containing unit.

24. A process in accordance with claim 23 wherein $R_1$ is

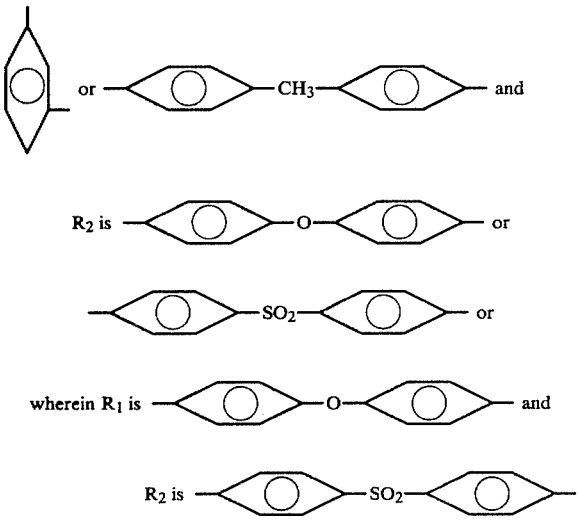

25. A process in accordance with claim 23 wherein Z is a trivalent benzene ring, $R_1$ is

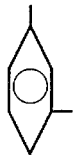

$R_2$ is

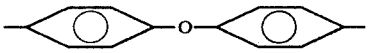

and wherein the concentration range runs from about 30 mole percent of the $R_1$ containing units and about 70 mole percent of the $R_2$ containing units to about 70 percent of the $R_1$ containing units and about 30 mole percent of the $R_2$ containing units.

26. A process in accordance with claim 23 wherein said polymer comprises from 10% to 50% by weight graphite fibers.

27. A process in accordance with claim 26 wherein said polymer comprises from 30% to 34% by weight graphite fibers.

28. A process in accordance with claim 23 wherein said polymer comprises from 10% to 60% by weight glass fibers.

29. A process in accordance with claim 28 wherein said polymer comprises from 30% to 34% by weight glass fibers.

* * * * *

UNITED STATES PATENT OFFICE
CERTIFICATE OF CORRECTION

Patent No. 4,430,970 Dated February 14, 1984

Inventor(s) Matthew W. Holtzberg, Steven J. Henke, Wray V. McKenzie, Jr.

It is certified that error appears in the above-identified patent and that said Letters Patent are hereby corrected as shown below:

| Patent Column | Line | |
|---|---|---|
| 2 | 7 | reads "tolerance" and should read --tolerances-- |
| 6 | 29 | reads "range" and should read --ranging-- |
| 14 | 37 | reads "said" (first occurrence) and should read --and-- |
| 16 | 18 | after the word "70" add --mole-- |

Signed and Sealed this

*Fourteenth* Day of *May 1985*

[SEAL]

*Attest:*

DONALD J. QUIGG

*Attesting Officer* *Acting Commissioner of Patents and Trademarks*